US010471439B2

(12) United States Patent
Kamees et al.

(10) Patent No.: US 10,471,439 B2
(45) Date of Patent: Nov. 12, 2019

(54) COMBINATION CENTRIFUGE AND MAGNETIC STIRRER

(71) Applicant: Heathrow Scientific LLC, Vernon Hills, IL (US)

(72) Inventors: Gary Dean Kamees, Gurnee, IL (US); Rainer Joseph Wohlgemuth, Palatine, IL (US); Alice Marie Jandrisits, Des Plaines, IL (US)

(73) Assignee: HEATHROW SCIENTIFIC LLC, Vernon Hills, IL (US)

( * ) Notice: Subject to any disclaimer, the term of this patent is extended or adjusted under 35 U.S.C. 154(b) by 600 days.

(21) Appl. No.: 15/157,125

(22) Filed: May 17, 2016

(65) Prior Publication Data

US 2017/0333916 A1 Nov. 23, 2017

(51) Int. Cl.

| | |
|---|---|
| ***B04B 5/10*** | (2006.01) |
| ***B01F 13/08*** | (2006.01) |
| ***B04B 9/02*** | (2006.01) |
| ***B04B 9/10*** | (2006.01) |
| ***B04B 5/04*** | (2006.01) |

(Continued)

(52) U.S. Cl.

CPC ..... *B04B 5/10* (2013.01); *B01F 9/0003* (2013.01); *B01F 13/0818* (2013.01); *B01F 15/00318* (2013.01); *B01F 15/00538* (2013.01); *B04B 5/0414* (2013.01); *B04B 9/00* (2013.01); *B04B 9/02* (2013.01); *B04B 9/10* (2013.01); *B04B 13/003* (2013.01); *B01F 2215/0037* (2013.01)

(58) Field of Classification Search

CPC ..... B04B 5/10; B04B 5/0414; B04B 9/00; B04B 9/02; B04B 13/003; B04B 9/10; B01F 13/0818; B01F 15/00318; B01F 9/0003; B01F 15/00538; B01F 2215/0037

USPC ..... 494/84, 43, 16; 366/279, 274

See application file for complete search history.

(56) References Cited

U.S. PATENT DOCUMENTS

| | | | |
|---|---|---|---|
| 2,809,020 A | 10/1957 | Magee et al. | |
| 3,749,369 A | 7/1973 | Landsberger | |

(Continued)

FOREIGN PATENT DOCUMENTS

| | | | |
|---|---|---|---|
| EP | 2517796 | * 10/2012 | ..... B04B 13/003 |
| EP | 2796077 | 10/2014 | |

(Continued)

OTHER PUBLICATIONS

EP 2517796 Espacenet Machine Translation.*

EP17171292.0 Extended European Search Report dated Oct. 17, 2017 (6 pages).

*Primary Examiner* — Charles Cooley

(74) *Attorney, Agent, or Firm* — Michael Best & Friedrich LLP

(57) ABSTRACT

A device for use in a laboratory and operable as both a centrifuge and a magnetic stirrer includes a housing defining a cavity therein, a motor coupled to the housing, and a spindle driven by the motor and rotatable about a first axis. The device also includes a first rotor removably couplable to the spindle and configured to support at least one tube therein, and a second rotor removably couplable to the spindle and including at least one magnet. The device also includes a controller in communication with the motor and operable in a first mode of operation when the first rotor is coupled to the spindle and operable in a second mode of operation when the second rotor is coupled to the spindle.

8 Claims, 11 Drawing Sheets

(51) Int. Cl.

| | |
|---|---|
| ***B04B 9/00*** | (2006.01) |
| ***B04B 13/00*** | (2006.01) |
| ***B01F 15/00*** | (2006.01) |
| ***B01F 9/00*** | (2006.01) |

(56) References Cited

U.S. PATENT DOCUMENTS

| | | | | |
|---|---|---|---|---|
| 4,118,801 | A | 10/1978 | Kraft et al. | |
| 4,341,343 | A | 7/1982 | Beckman | |
| 5,480,484 | A | 1/1996 | Kelley et al. | |
| 5,505,684 | A | 4/1996 | Piramoon | |
| 5,679,154 | A | 10/1997 | Kelley et al. | |
| 6,095,677 | A | 8/2000 | Karkos, Jr. et al. | |
| 6,100,618 | A * | 8/2000 | Schoeb | F04D 1/006 310/90 |
| 6,210,033 | B1 | 4/2001 | Karkos, Jr. et al. | |
| 6,336,603 | B1 | 1/2002 | Karkos, Jr. et al. | |
| 6,579,002 | B1 | 6/2003 | Bartick et al. | |
| 6,709,148 | B2 | 3/2004 | Glass | |
| 6,793,167 | B2 | 9/2004 | Karkos, Jr. et al. | |
| 6,908,223 | B2 | 6/2005 | Bibbo et al. | |
| 6,988,825 | B2 | 1/2006 | Coville et al. | |
| 7,364,350 | B2 | 4/2008 | Coville et al. | |
| 8,550,696 | B2 | 10/2013 | Ebers et al. | |
| 2003/0214876 | A1 | 11/2003 | Glass | |
| 2004/0002415 | A1 * | 1/2004 | Jang | B04B 5/0414 494/10 |
| 2004/0022123 | A1 | 2/2004 | Coville et al. | |
| 2006/0177936 | A1 | 8/2006 | Shneider et al. | |
| 2006/0187743 | A1 | 8/2006 | Carreras | |
| 2009/0025562 | A1 * | 1/2009 | Hallgren | B01D 45/14 96/216 |
| 2010/0046323 | A1 | 2/2010 | Tien et al. | |
| 2012/0195863 | A1 * | 8/2012 | Alt | B04B 5/0414 424/93.7 |
| 2012/0291637 | A1 | 11/2012 | Yu | |
| 2015/0011348 | A1 | 1/2015 | Vester | |
| 2015/0036450 | A1 | 2/2015 | Vester | |
| 2017/0333916 | A1 * | 11/2017 | Kamees | B01F 13/0818 |

FOREIGN PATENT DOCUMENTS

| | | | |
|---|---|---|---|
| GB | 2498953 | 8/2013 | |
| WO | WO-2007142408 A1 * | 12/2007 | B04B 5/0421 |
| WO | 2014207243 | 12/2014 | |

* cited by examiner

COMBINATION CENTRIFUGE AND MAGNETIC STIRRER

BACKGROUND

The present disclosure relates to lab equipment, and more specifically to a device that is operable as both a centrifuge and a magnetic stirrer.

In laboratories, lab equipment consumes large quantities of space. This is particularly true for table-top devices which compete for space and location with many other devices. Furthermore, the laboratory typically requires numerous devices, each of which performs particular tasks in the lab. It would be more space efficient and more convenient for the user if a single device would be able to perform multiple tasks that would normally require the use of multiple, independent devices.

SUMMARY

In one aspect, a device for use in a laboratory includes a housing defining a cavity therein, a motor coupled to the housing, and a spindle driven by the motor and rotatable about a first axis. The device also including a first rotor removably couplable to the spindle and configured to support at least one tube therein, a second rotor removably couplable to the spindle and including at least one magnet, and a controller in communication with the motor and operable in a first mode of operation when the first rotor is coupled to the spindle, and operable in a second mode of operation when the second rotor is coupled to the spindle.

In another aspect, a device operates with both a first rotor having a first rotor ID, and a second rotor having a second rotor ID different than the first rotor ID, the device coupling with only one of the first and the second rotors at a time. The device includes a housing at least partially defining a cavity therein, and a motor coupled to the housing. The device also includes a spindle driven by the motor and rotatable about a first axis, where the spindle is releasably couplable to a selected one of the first rotor and the second rotor. The device also includes a controller in operable communication with the motor, where the controller is configured to detect which rotor is releasably coupled to the spindle based at least in part on the rotor ID present.

In still another aspect, a device for operating a first rotor having a first attribute and a second rotor having a second attribute different than the first attribute includes a housing at least partially defining a volume therein, and a motor coupled to the housing. The device also includes a spindle driven by the motor and rotatable about a first axis, where the spindle is configured to be releasably coupled to a given one of the first rotor and the second rotor. The device also includes a controller in operable communication with the motor, the controller configured to adjust an envelope of operation of the motor based at least in part on which rotor is coupled to the spindle.

In still another aspect, a device that provides both centrifuge and magnetic stirrer functions includes a housing at least partially defining a cavity therein, and a motor coupled to the housing. The device also includes a spindle driven by the motor and rotatable about a first axis, a rotor removably coupled to the spindle for rotation therewith, and a controller in communication with the motor and operable in a centrifuge mode of operation and a magnetic stirrer mode of operation, where the device is configured to support one or more tubes when operating in the centrifuge mode of operation, and where the device is configured to rotate one or more magnets in the magnetic stirrer mode of operation.

Other aspects of the disclosure will become apparent by consideration of the detailed description and accompanying drawings.

DETAILED DESCRIPTION

Figure 1:
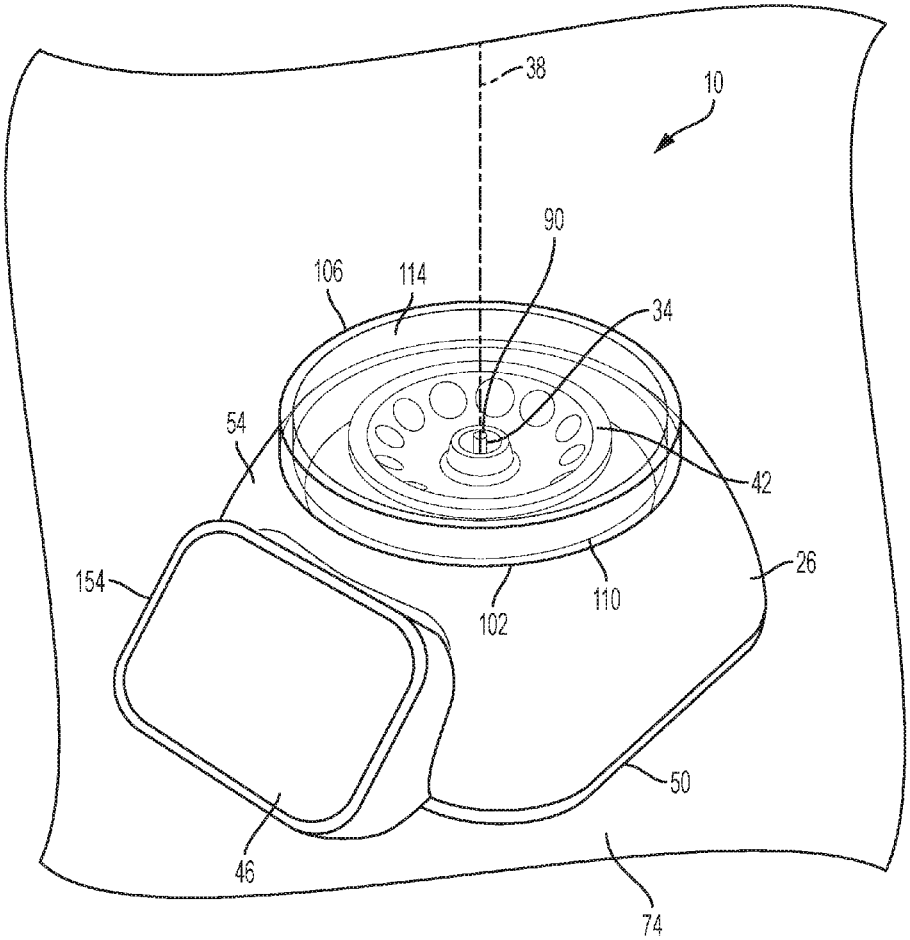
FIG. 1 is a perspective view of the device of the present invention with the lid in a closed position and a centrifuge rotor installed.

Before any constructions of the disclosure are explained in detail, it is to be understood that the disclosure is not limited in its application to the details or arrangement of components set forth in the following description or illustrated in the accompanying drawings. The disclosure is capable of supporting other implementations and of being practiced or of being carried out in various ways.

FIGS. 1-4 generally illustrate a device 10 for use in a laboratory (clinical, research, industrial, field, or educational) which provides both centrifuge and magnetic stirrer functions. The device 10 is generally operable in two distinct modes of operation: a first centrifuge mode, and a second magnetic stirrer mode. More specifically, when operating in the first mode of operation, the device 10 is configured to support one or more tubes 14 therein, including but not limited to test tubes, centrifuge tubes, micro-centrifuge tubes, strip tubes, conical tubes, and the like. (FIG. 1) Furthermore, the device 10 is configured to operate at rotational speeds associated with centrifugation (e.g., about 0 RPM to about 30,000 RPM and higher). When operating in the second mode of operation, the device 10 is able to support a container 18 thereon (FIG. 4), interact with a stir bar 22 positioned within the container 18, and operate at the rotational speeds generally associated with magnetic stirring (e.g., about 0 RPM to about 4,000 RPM).

In the illustrated construction of FIGS. 1-5, the device 10 includes a housing 26, a motor 30 at least partially positioned within the housing 26, a spindle 34 driven by the motor 30 and rotatable about an axis 38, and a plurality of interchangeable rotors 42, each rotor 42 being removably couplable to the spindle 34 and rotatable therewith. The device 10 also includes a controller 46 in operable communication with the motor 30 and configured to dictate the rotational speed and direction of the spindle 34 in the two modes of operation.

Figure 2:
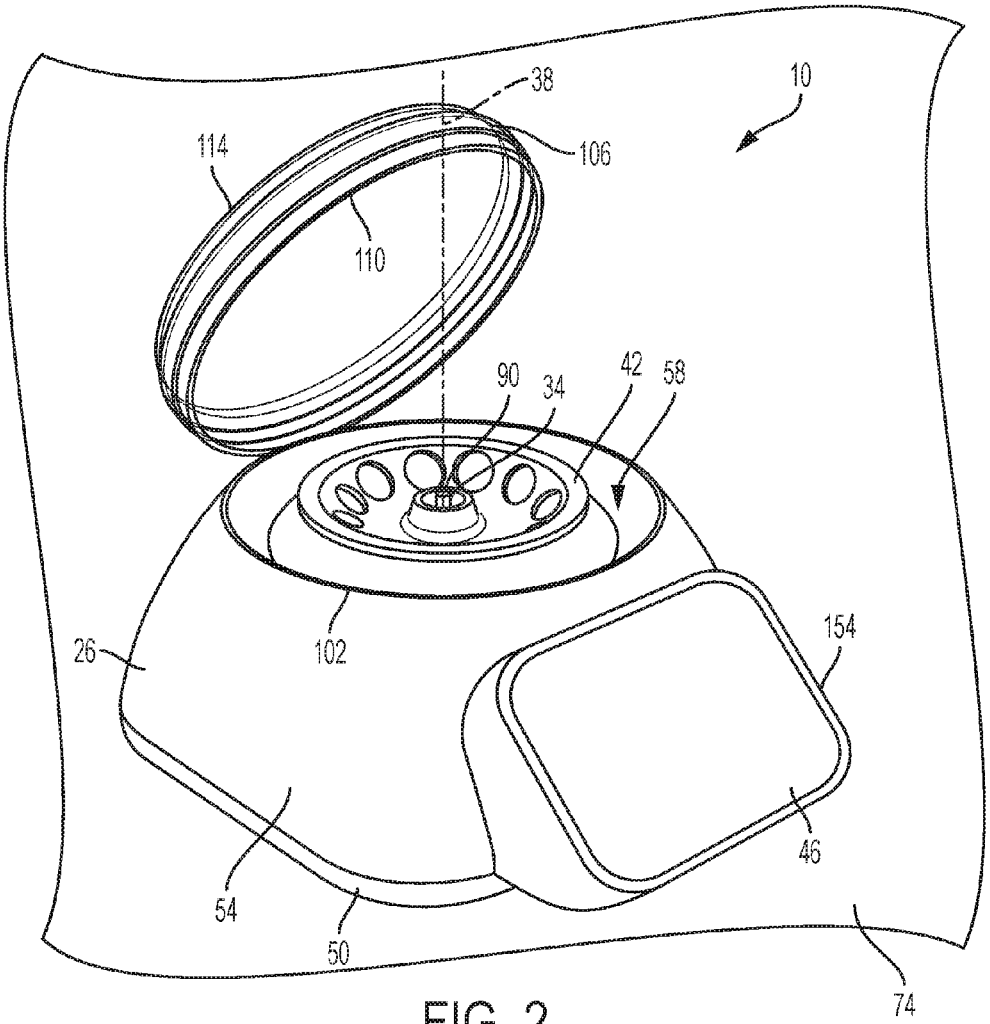
FIG. 2 is a perspective view of the device of FIG. 1 with the lid in an open position.
Figure 3:
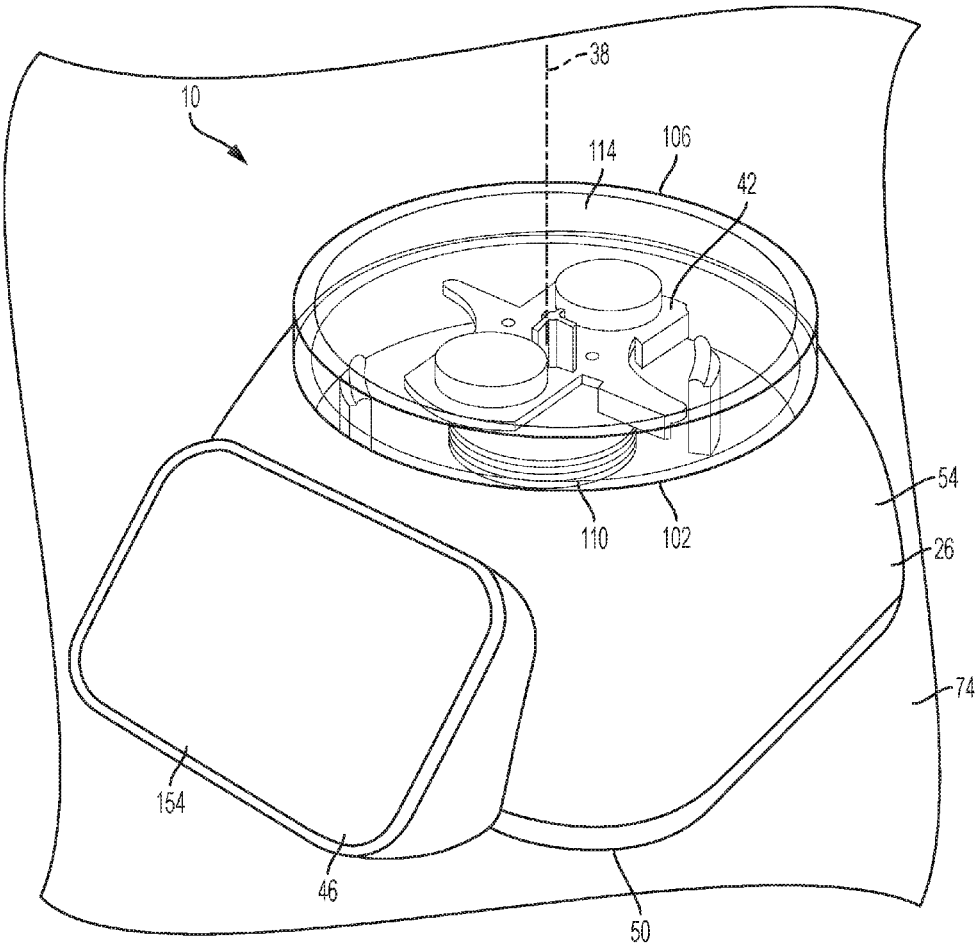
FIG. 3 is a perspective view of the device of FIG. 1 with a magnetic stirrer rotor installed instead of a centrifuge rotor.
Figure 4:
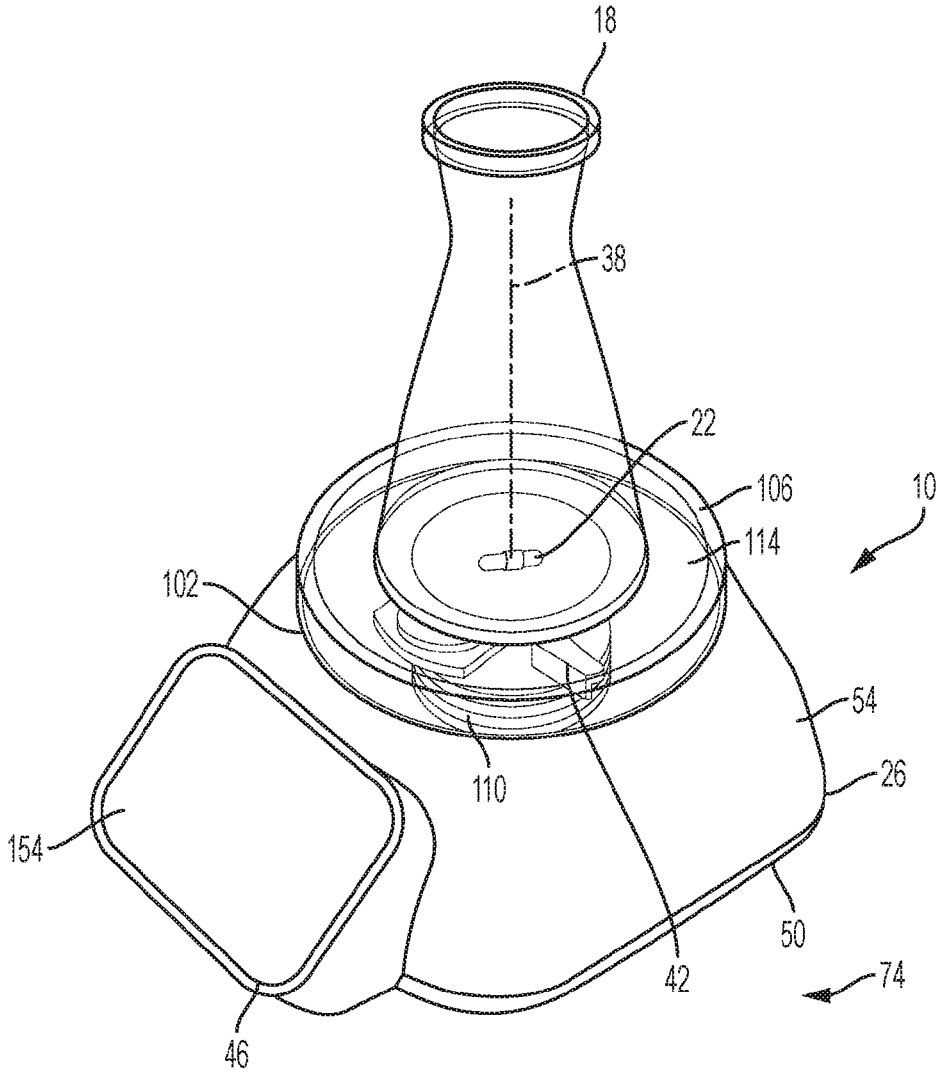
FIG. 4 is a perspective view of the device of FIG. 3 with a vessel positioned on the lid.

Illustrated in FIGS. 1-5, the housing 26 of the device 10 includes a base plate 50 and a casing 54 coupled to the base plate 50 to form a cavity 58 therebetween. In the illustrated construction, the casing 54 of the housing extends upwardly from the upper surface 62 of the base plate 50 to at least partially define the cavity 58 and an opening 102 in communication with the cavity 58. The opening 102, in turn, is sized and shaped to allow the rotor 42 to pass therethrough. In the illustrated construction, the opening 102 is substantially circular in shape and positioned proximate the top, center of the housing 26 (FIG. 2).

The base plate 50 of the housing 26 is substantially rectangular in shape having an upper surface 62 and a lower surface 66 opposite the upper surface 62. The base plate 50 also includes a plurality of feet 70, each foot 70 extending beyond the lower surface 66 of the plate 50 and being configured to support the device 10 on a support surface or table top 74. In the illustrated construction, each foot includes a rubber pad to minimize slippage on the support surface 74 and at least partially dampen any vibrations produced by the rotation of the spindle 34 and rotor 42. In alternative constructions, each foot 70 may include an adjustable leg (not shown) to compensate for the grade of the support surface 74 or to adjust the height at which the device 10 rests.

The housing 26 also includes a lid 106 pivotably coupled to the casing 54 and configured to selectively cover the opening 102. The lid 106 is substantially cylindrical in shape, having an edge 110 that substantially corresponds with shape and size of the opening 102 of the housing 26. The lid 106 also has a substantially planar upper surface 114 sized to support a beaker or other container 18 thereon. During use, the lid 106 is pivotable with respect to the housing 26 between an open position (FIG. 2), where the user has access to the cavity 58 via the opening 102, and a closed position (FIG. 1), where the user does not have access to the cavity 58 via the opening 102. When the lid 106 is in the closed position, the upper surface 114 of the lid 106 is generally level so that a container 18 positioned thereon will remain in place without falling or sliding. Although not illustrated, the lid 106 may also include an integral heater to warm the upper surface 114 and any vessels placed thereon.

Although the illustrated lid 106 is pivotably attached to the housing 26, in alternative constructions the lid 106 may be disconnected and removable from the housing 26. Furthermore, the lid 106 may include a spring or other biasing member (not shown) to bias the lid 106 into the open position. Still further, the lid 106 may include a latch or other locking member (not shown) to secure the lid 106 in the closed position. In still other constructions, the lid 106 may include a ridge or seal (not shown) on the edge 110 to engage and form a seal with the perimeter of the opening 102 to better isolate the cavity 58 from the surrounding atmosphere and avoid contamination of any tubes 14 positioned within the cavity 58.

Figure 5:
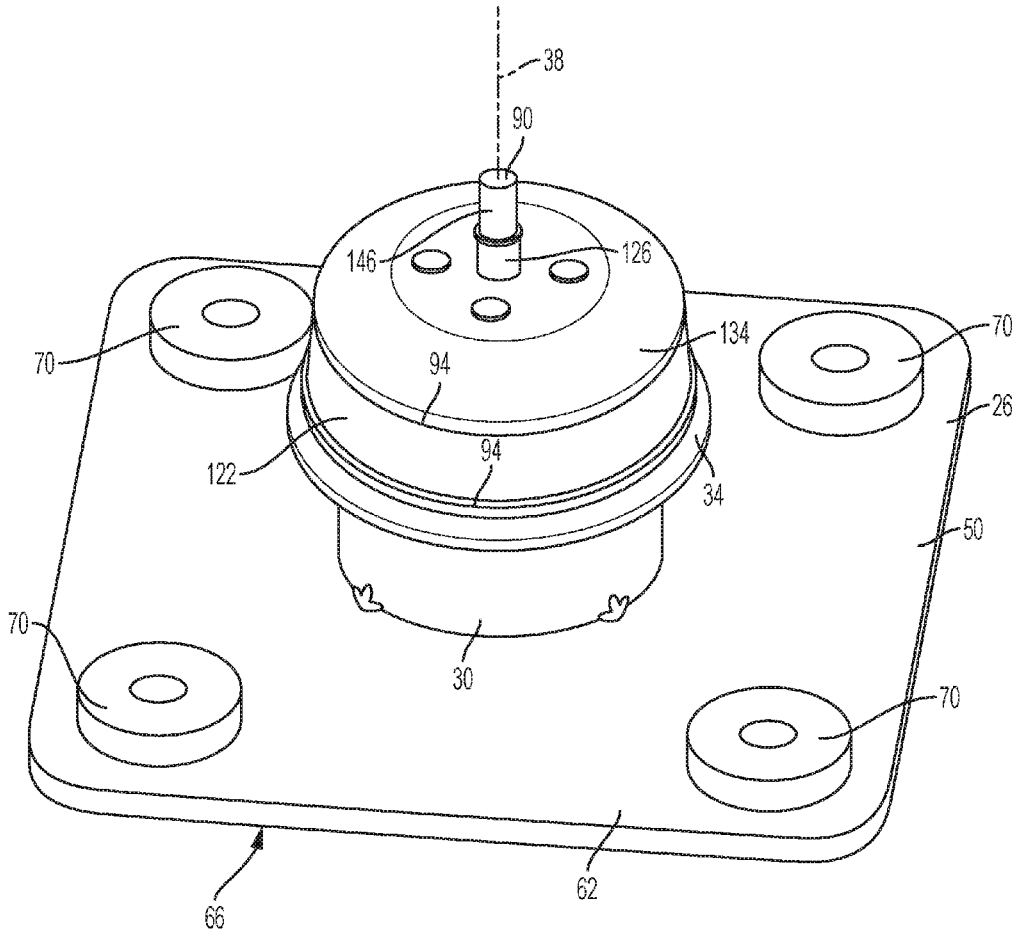
FIG. 5 is a perspective view of the device of FIG. 1 with the casing removed for clarity.

Illustrated in FIG. 5, the motor 30 of the device 10 is in operable communication with the controller 46 and configured to rotate the spindle 34 about its axis 38. The motor 30 includes an output shaft and is generally operable over a wide range of rotational speeds corresponding to both the speeds required for centrifugation (i.e., between about 0 RPMs and about 30,000 RPM and higher) and those required for magnetic stirring (i.e., between about 0 RPMs and about 4000 RPMs). The motor 30 may also be operable in both a clockwise and counterclockwise direction. When assembled, the motor 30 of the device 10 is generally mounted, by one or more fasteners (not shown), to the upper surface 62 of the base plate 50 and aligned co-axially with the opening 102 of the casing 54.

Illustrated in FIG. 5, the spindle 34 of the device 10 is driven by the motor 30 and rotatable about an axis of rotation 38. The spindle 34 generally includes a base 122 and a shaft 126 extending through the base 122 to define a distal end 90. When assembled, the axis of rotation 38 of the spindle 34 is substantially aligned co-axially with the opening 102 of the housing 26 such that a rotor 42 introduced through the opening 102 will be generally aligned with the spindle 34. In the illustrated construction, the spindle 34 is formed integrally with the output shaft of the motor 30. However, in alternative constructions, the spindle 34 may be formed separately from the output shaft and be driven by a gear train and the like (not shown). In such constructions, the gear train may be utilized to increase or decrease the speed and torque output of the motor 30 as desired. Still further, the gear train may include a clutch or other mechanism to releasably couple the output shaft with the spindle 34.

The base 122 of the spindle 34 is configured to properly position and support the rotor 42 co-axially with the axis of rotation 38 when the rotor is positioned on the spindle 34. In the illustrated construction, the base 122 of the spindle 34 is substantially dome shaped forming an outer positioning surface 134 configured to contact a corresponding rotor positioning surface 138 of the rotor 42 (described below). It is preferable that the outer positioning surface 134 is contoured such that the rotor 42 will naturally align itself with the axis of rotation 38 as the rotor 42 is axially introduced onto the spindle 34 via the opening 102. In the illustrated construction, the base 122 also includes a pair of o-rings 94 placed in grooves 98 formed into the outer positioning surface 134 (FIG. 5) to minimize vibrations during operation and more securely position the rotor 42 on the outer positioning surface 134 during use.

The shaft 126 of the spindle 34 extends axially beyond the base 122 to a distal end 90. The shaft 126 is configured to operate in conjunction with the base 122 to position the rotor 42 co-axially with the axis of rotation 38 and to also assist in securing the rotor 42 to the spindle 34. In the illustrated construction, the shaft 126 of the spindle 34 includes a threaded portion 146 proximate the distal end 90 that is sized to threadably receive a locking nut 150 thereon. The locking nut 150 in turn can be tightened manually by the user to secure the rotor 42 to the spindle 34 during operation of the device 10.

In the illustrated construction, the frictional forces created via the locking nut 150 are sufficient to transmit the necessary torque between the rotor 42 and the spindle 34 to assure the two elements rotate together synchronously as a unit. However, in alternative constructions, the spindle 34 may include a plurality of splines, protrusions, or other indexing geometry (not shown) to transmit torque between the spindle 34 and the rotor 42 and rotationally lock the two elements together. Furthermore, while the illustrated construction includes a locking nut 150 to secure the rotor 42 to the spindle 34, in alternative constructions, the spindle 34 may include a quick release mechanism, such as a detent (not shown), to allow for easy installation and quick removal of each rotor 42 onto and off of the spindle 34.

Illustrated in FIGS. 1-4, the controller 46 of the device 10 communicates with the motor 30 and is configured to output signals thereto dictating the speed and direction at which the spindle 34 rotates about the axis 38. The controller 46 includes an interface 154 and is operable in at least two distinct modes of operation. In the illustrated construction, the interface 154 includes a touchscreen formed in the housing 26.

The interface 154 of the controller 46 is configured to allow the user and other devices to exchange information with the controller 46 in the form of inputs (i.e., receiving information from the user or other devices) and outputs (i.e., providing information to the user or other devices). In particular, the interface 154 may include any combination of buttons, touchscreen icons, toggle switches, data ports, and the like which allow the exchange of information either between the user and the controller 46 or between another device and the controller 46. During use, the interface 154 may be configured to receive various forms of inputs from the user, such as but not limited to, the type of rotor 42 installed on the spindle 34, the desired operating mode, the desired length of operation, the desired rotational speed of the spindle 34, the measured rotational speed of the rotor 42, whether the rotor 42 is secured to the spindle 34, and the like. In some constructions, some inputs may also be measured and communicated to the controller 46 automatically. For example, the type of rotor 42 may be detected by the controller 46 when it is installed on the spindle 34 (described below).

Furthermore, the interface 154 may also provide information back to the user in the form of outputs. In particular, the interface 154 may include one or more screens or one or more indicating lights. The outputs may include, but are not limited to, the current rotor type installed on the spindle, the current operating status, the current operating mode, the current speed of the spindle, and the like.

During use, the controller 46 of the device 10 receives inputs from the user and other devices via the interface 154 and various sensors (not shown), processes the data received, then outputs signals to the motor 30. More specifically, the controller 46 is configured to limit the range of operable motor speeds to a specified envelope of operation based at least in part on the desired mode of operation. In the present application, limiting the envelope of operation constitutes reducing the range of spindle rotation speeds that the motor 30 is permitted to operate at during a particular test. More specifically, although the operational capabilities of the motor 30 may extend over a large band of speeds, the controller 46 will limit which speeds it will permit the motor 30 to operate at dependent upon a number of factors. For example, the ranges may be limited by the general operating conditions (i.e., stirring vs. centrifugation), by the capabilities of the device itself (i.e., load, weight, or duty cycle limitations), or may be set by the user to accommodate particular safety or operating protocol (i.e., taking into account the specific type, toxicity, or volatility of the materials being worked on).

When operating in the centrifuge or first mode of operation, the controller 46 is configured to limit the range of speeds at which the spindle 34 may operate to a first envelope of operation including rotational speeds appropriate for centrifugation such as between about 0 RPM to about 8,000, 10,000, 15,000, 30,000 or higher RPM. In still other constructions, the controller 46 may further limit the first envelope of operation into sub-envelopes of operation dependent upon the specific number of samples in the rotor 42 or the tube 14 size being used.

When operating in the magnetic stirrer or second mode of operation, the controller 46 is configured to limit the range of speeds at which the spindle 34 may operate to a second envelope of operation. The second envelope of operation is different than the first envelope of operation and is generally limited to the rotational speeds appropriate for stirring operations, such as spindle rotational speeds between about 0 RPM to about 2,500, 3,000, 4,000 or about 5,000 RPM. In still other constructions, the controller 46 may further limit the second envelope of operation into sub-envelopes of operation dependent upon the substance being stirred or the size of the stir bar 22 being used.

FIGS. 6-9 generally illustrate various rotor types 42*a*, 42*b*, 42*c*, 42*d* for use with the device 10. Each rotor 42 is releasably couplable to the spindle 34 and rotatable therewith. Generally speaking, each rotor illustrated below falls within two major groups: centrifugation rotors, or rotors designed to receive one or more tubes 14 therein (e.g., 42*a*, 42*b*, 42*c*); and magnetic stirring rotors, or rotors having magnets coupled thereto for driving a corresponding stir bar 22 (e.g., 42*d*). During use, each of the rotors 42 are interchangeable with one another allowing the user to swap out a rotor with one set of attributes for another rotor having a different set of attributes to accommodate the specific requirements of a particular test. For example, attributes that may vary between different rotors 42 can include, but are not limited to, the size of tubes the rotor can accommodate, the number of tubes the rotor can accommodate, the orientation of the tubes with respect to one another, the ability of the tubes to pivot or move with respect to one another, the inclusion of magnets, and the like.

Figure 6:
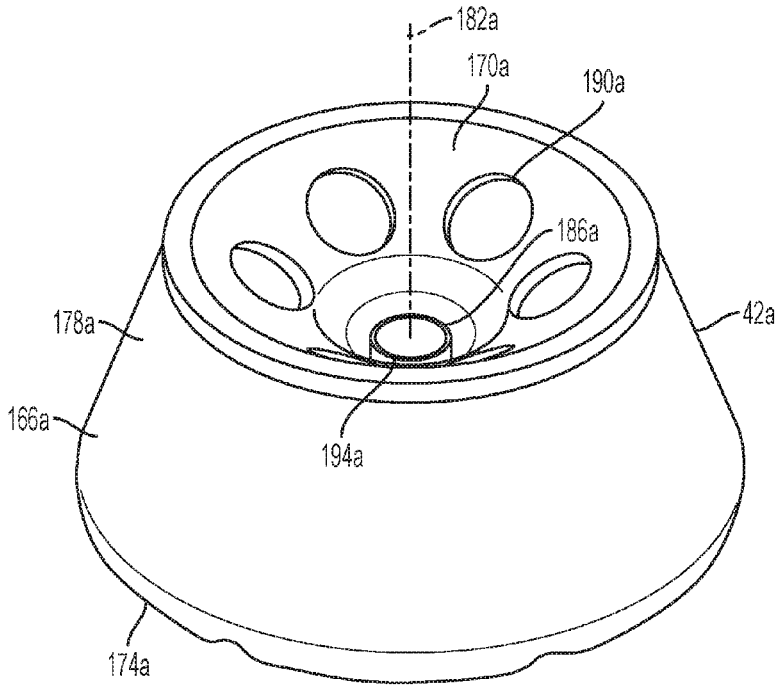
FIGS. 6 and 6*a* are perspective view of a first rotor construction.
Figure 6A:
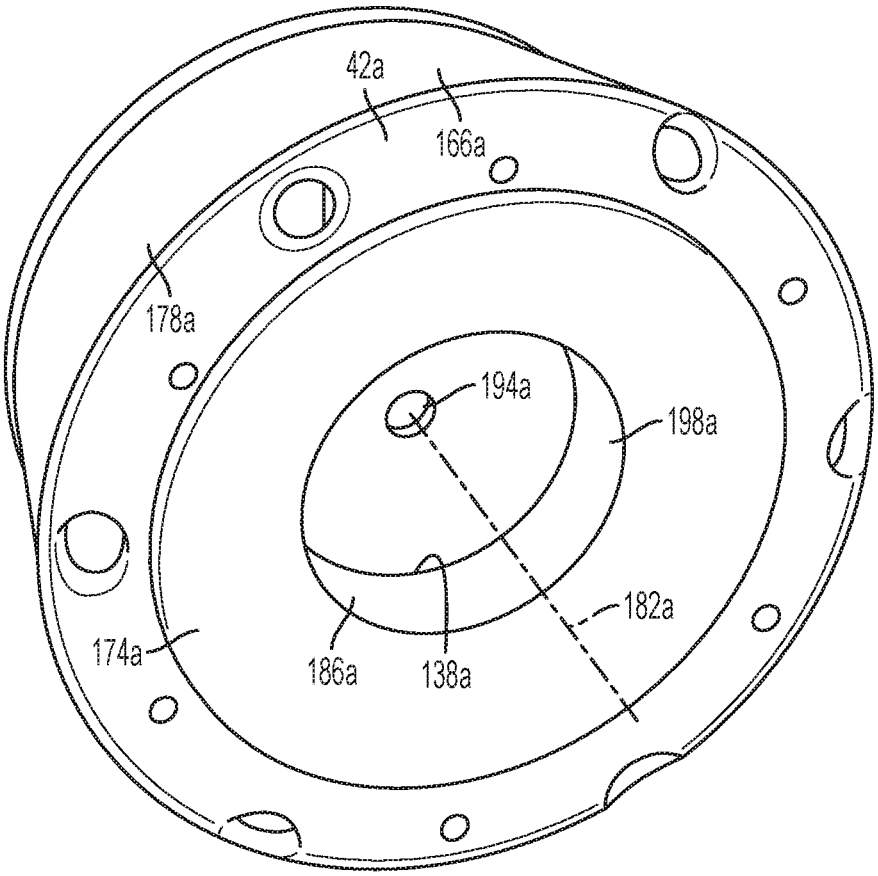

FIGS. 6 and 6*a* illustrate a first rotor construction 42*a* configured for the centrifugation of samples in 5 mL tubes. The rotor 42*a* includes a body 166*a* that is generally frusto-conical in shape having an upper surface 170*a*, a lower surface 174*a* opposite the upper surface 170*a*, and a sidewall 178*a* extending therebetween. The body 166*a* of the first rotor 42*a* also defines an axis 182*a* extending therethrough and a mounting aperture 186*a*. In the illustrated construction, the upper surface 170*a* of the body 166*a* is substantially concave in contour and defines a plurality (i.e., 6) of apertures 190*a*. The apertures 190*a* in turn are each sized to receive at least a portion of a 5 mL tube therein.

The mounting aperture 186*a* of the first rotor 42*a* includes a first cavity 194*a* extending axially inwardly from the upper surface 170*a* to define a first inner diameter, and a second cavity 198*a* extending between the first cavity 194*a* and the lower surface 174*a* to define the rotor positioning surface 138*a*. More specifically, the second cavity 198*a* of the mounting aperture 186*a* is sized and shaped to receive at least a portion of the base 122 of the spindle 34 therein, whereby contact between the rotor positioning surface 138*a* and the outer positioning surface 134 cause the rotor 42*a* to become co-axially aligned with the axis of rotation 38. Furthermore, the first cavity 194*a* of the mounting aperture 186*a* is sized and shaped to receive at least a portion of the shaft 126 therein whereby the locking nut 150 threaded onto the shaft 126 will contact the upper surface 170*a* of the rotor 42*a*.

Figure 7:
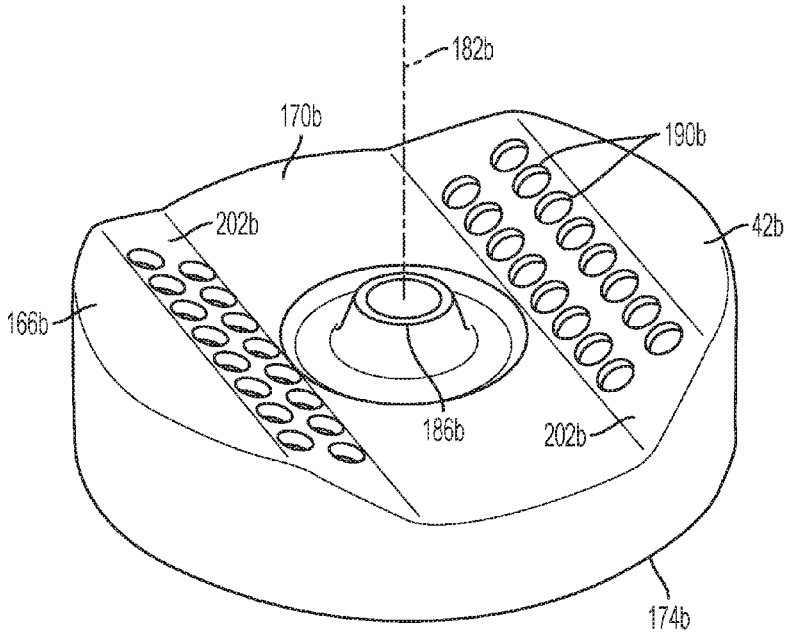
FIG. 7 is a perspective view of a second rotor construction.

FIG. 7 illustrates a second rotor construction 42*b* configured for the centrifugation of samples contained in a plurality of 0.2 mL or similar tube strips. More specifically, the rotor 42*b* includes a body 166*b* that is generally disk shaped having an upper surface 170*b*, and a lower surface 174*b* opposite the upper surface 170*b*. The second rotor 42*b* defines an axis 182*b* therethrough and a mounting aperture 186*b* aligned with the axis 182*b*. The mounting aperture 186*b* is substantially similar in size, shape, and function to the mounting aperture 186*a* described above.

In the illustrated construction, the upper surface 170*b* of the second rotor 42*b* includes a pair of angled surfaces 202*b* facing one another. Each surface 202*b* in turn defines a plurality of apertures 190*b*, each positioned in a set of substantially parallel, linear rows and sized to receive at least a portion of a tube therein.

Figure 8:
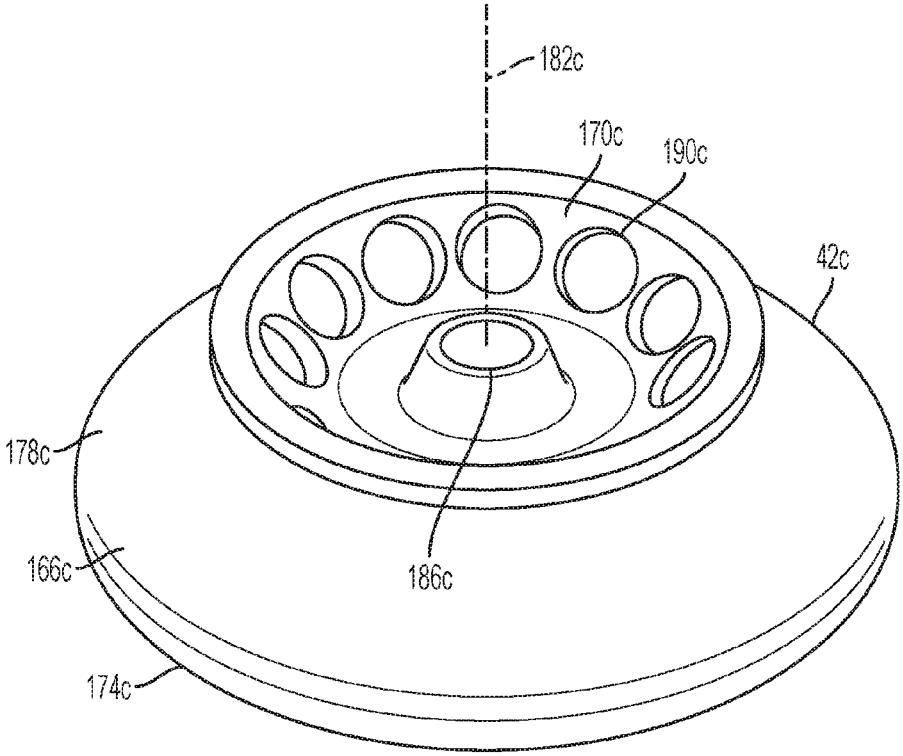
FIG. 8 is a perspective view of a third rotor construction.

FIG. 8 illustrates a third rotor construction 42*c* configured for the centrifugation of samples contained in 1.5 mL tubes. The rotor 42*c* includes a body 166*c* that is generally frusto-conical in shape having an upper surface 170*c*, a lower surface 174*c* opposite the upper surface 170*c*, and a sidewall 178*c* extending therebetween. The body 166*c* of the third rotor 42*c* also defines an axis 182*c* therethrough and a mounting aperture 186*c*. The mounting aperture 186*c* is similar in size, shape, and function to the mounting aperture 186*a* described above. In the illustrated construction, the upper surface 170*c* of the body 166*c* is substantially concave in contour and defines a plurality (e.g., 12) of apertures 190*c*. The apertures 190*c* in turn are each sized to receive at least a portion of a 1.5 mL tube therein.

Figure 9:
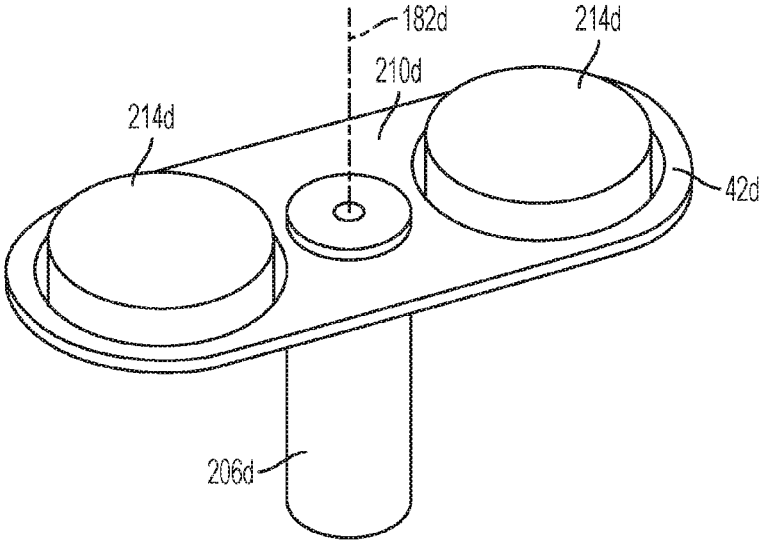
FIG. 9 is a perspective view of a fourth rotor construction.

FIG. 9 illustrates a fourth rotor construction 42*d* configured for the magnetic mixing of a sample contained in a separate container or beaker 18 that is positioned on the upper surface 114 of the lid 106. The fourth rotor 42*d* includes a shaft 206*d*, sized and shaped to be coupled to the shaft 126 of the spindle 34, and a blade member 210*d* coupled to the shaft 126 for rotation therewith. In the illustrated construction, the fourth rotor construction 42*d* includes a pair of magnets 214*d* coupled to the blade member 210*d* opposite one another and configured to rotate about the axis 38 as the spindle 34 rotates. The rotation of the magnets 214*d* in turn cause the stir bar 22, positioned in the container 18, to rotate about the axis 38.

The device 10 also includes a rotor identification system 250 in communication with the controller 46. The rotor ID system 250 uses one or more sensors 254 to detect the type or style of rotor 42 presently installed in the device 10 and utilize that information to change one or more operating parameters. In the illustrated constructions, the rotor identification system 250 includes a sensor 254 coupled to the base plate 50 of the device 10 and in operable communication with the controller 46, and a rotor ID tag 258 coupled to or otherwise formed in the rotor 42. After the user has installed a particular rotor 42 onto the spindle 34, the sensor 254 will read the rotor ID tag 258 and extract any information contained therein. Upon receiving the extracted information, the controller 46 will then automatically set the device to operate in either the first mode of operation or the second mode of operation based at least in part on the information detected.

The controller 46 may also set specific test parameters automatically based at least in part on the information extracted from a rotor's ID tag 258. For example, a specific rotor's ID tag 258 may include all the test parameters for a particular type of test (i.e., blood separation). Once that particular rotor is installed in the device 10, the controller 46 will read the rotor ID tag 258 and set all the test parameters (i.e., time, speed, etc.) necessary to carry out blood separation. Such a feature is particularly useful in instances where a single test may include multiple entries, each for a specific time and speed, so as to limit the number of inputs the user has to make. In still other instances, the user may be able to associate a particular set of commands to a particular rotor ID tag 258. In such instances the test parameters would not be pre-determined, but rather input by the user once, and recalled every time that particular rotor 42 is used. The rotor ID tag 258 may include information relating to, but is not limited to, the type of rotor (i.e., centrifuge or magnetic stirring), specific test parameters (i.e., speed, duration, direction, etc.), rotor layout information (i.e., size of tube accommodated, number of tubes accommodated, etc.), rotor serial number, and the like.

Figure 10A:
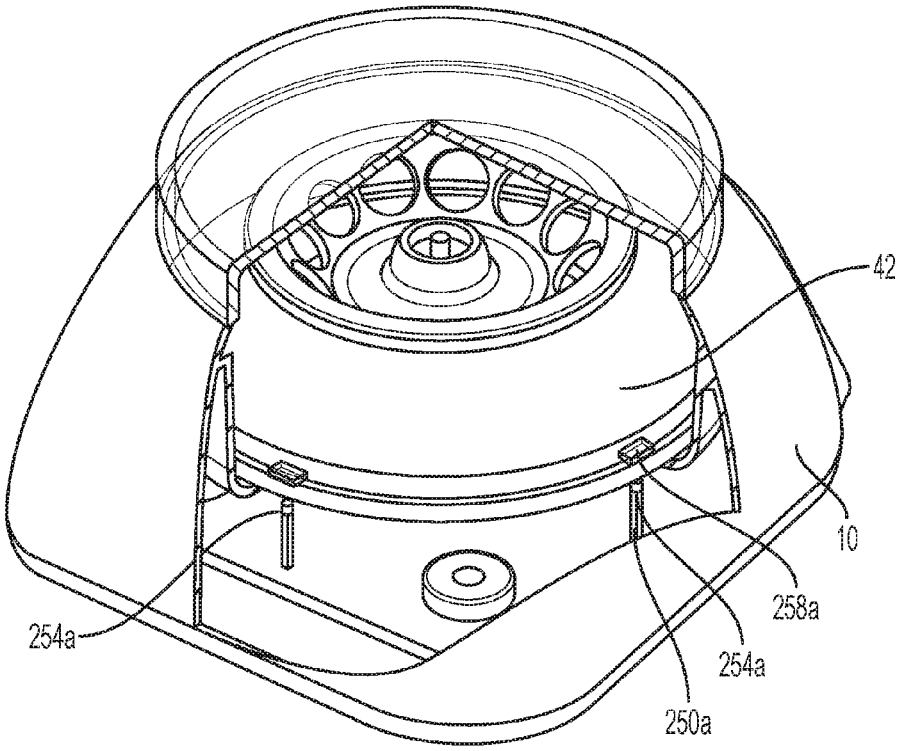
FIGS. 10*a*-10*c* illustrate the device of FIG. 1 with the casing sectioned away to show various constructions of a rotor identification system.

Illustrated in FIG. 10*a*, one construction of the rotor identification system 250*a* utilizes Hall Effect technology to transmit information between the rotor 42 and the controller 46. In such a construction, the rotor ID tag 258*a* includes a specific number and/or strength of magnets coupled to the rotor 42, and the sensor 254*a* is a Hall Effect sensor coupled to the base plate 50. More specifically, the rotor ID tag 258*a* includes a plurality of magnets positioned along a bottom edge of the rotor 42 such that the position, spacing, and/or number of magnets may be utilized to establish a unique rotor ID code.

During use, the magnets of the user ID tag 258*a* generally come into and out of range of the Hall Effect sensor 254*a* as the rotor 42 rotates. To assure the hall effect sensor 254*a* is able to detect each of the magnets and form a proper ID, the rotor identification system 250*a* may perform a "test spin" after the rotor 42 is installed but before the start of the actual experiment to allow the sensor 254*a* to read the rotor ID tag 258*a*. More specifically, the test spin may include rotating the rotor 42 at a known speed for a known period of time (i.e., 2 seconds at 200 RPM) or rotating the rotor 42 for a known number of revolutions (i.e., 10 revolutions). During the test spin process, the rotation of the rotor 42 with respect to the base plate 50 causes each of the magnets of the ID tag 258*a* to pass by the sensor 254*a* such that the sensor 254*a* is able to detect and identify each one individually. This information, combined with the information received by the controller 46 regarding the speed of the rotation of the rotor 42, allows the controller 46 to determine the number and distance between each magnet which, in turn, allows the controller 46 to form a proper ID of the rotor 42 itself.

Figure 10B:
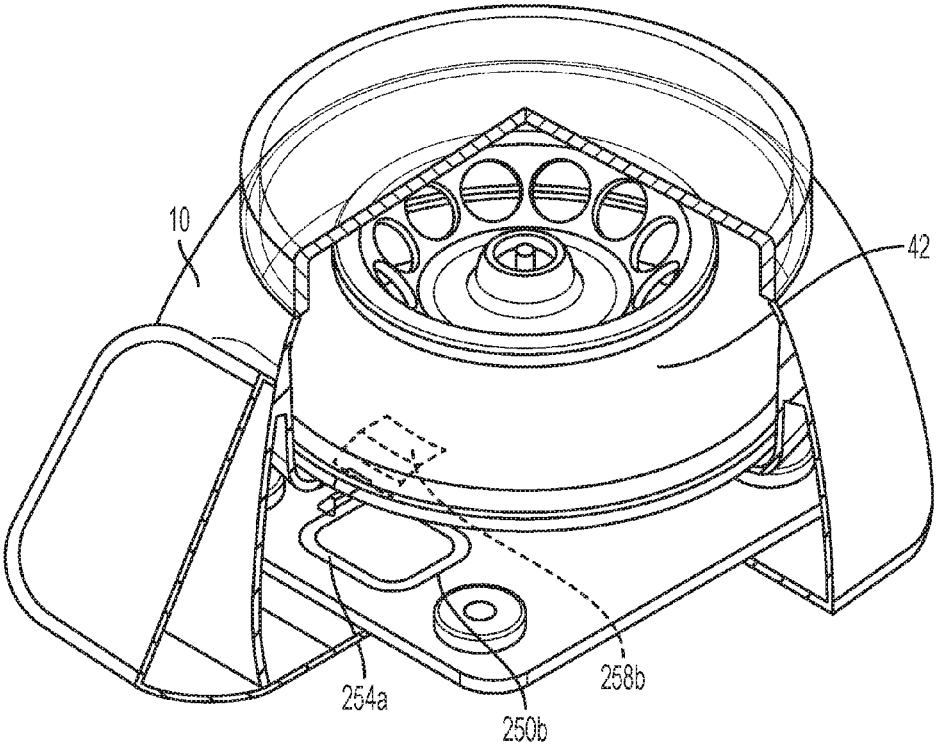

Illustrated in FIG. 10*b*, another construction of the rotor identification system 250*b* utilizes radio frequency identification (RFID) technology to transmit information between the rotor 42 and the controller 46. In such a construction, an RFID tag is coupled to the rotor 42, and the sensor 254*b* includes an RFID sensor coupled to the base plate 50 of the device 10. As is known in the RFID art, each tag 258*b* includes a unique signal that can be interpreted by the sensor 254*b*. Depending upon the range of the sensor 254*b*, the rotor identification system 250*b* may also be initiated by a test spin (described above) to assure the RFID tag 258*b* passes within range of the sensor 254*b* and an accurate reading is made.

Figure 10C:
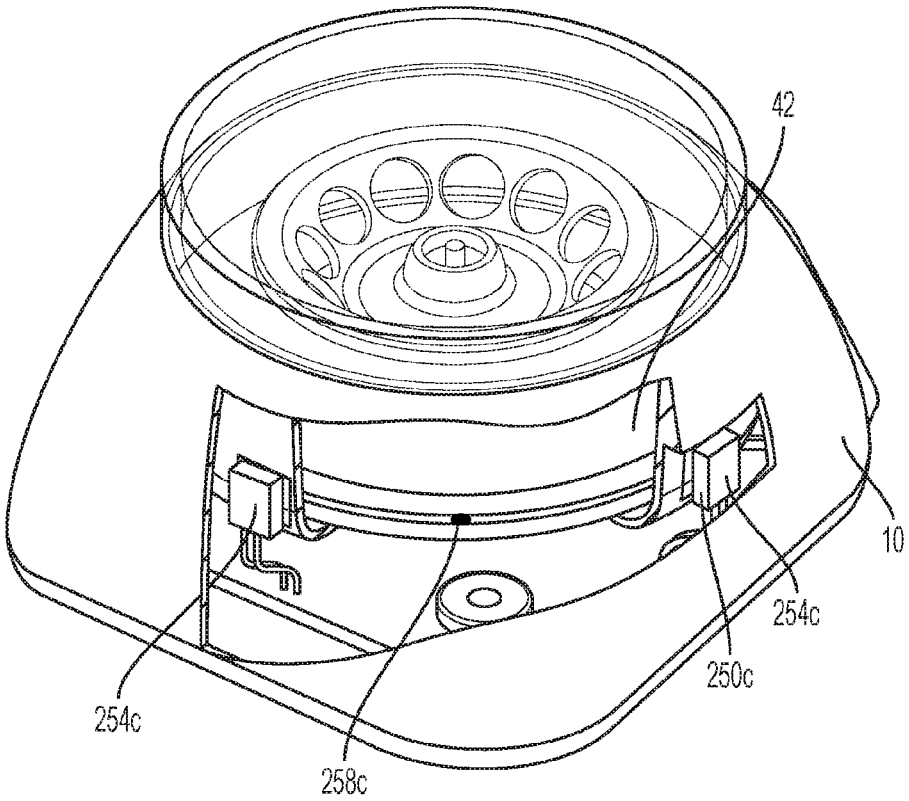

Illustrated in FIG. 10*c*, another construction of the rotor identification system 150*c* utilizes infrared sensor technology to transmit information between the rotor 42 and the controller 46. In such a construction, the rotor ID tag 258*c* includes a bar code or similar markings printed onto the outer surface of the rotor 42, and the sensor 254*c* includes an optical reader coupled to the base plate 50 and positioned to view the markings on the outer surface. More specifically, the size, location, shape, and number of markings create a unique code that can be detected by the sensor 254*c*. To permit the optical reader 254*c* to view each of the markings and make an accurate reading, the rotor identification system 250*c* undergoes a test spin (described above) after the rotor 42 has been installed on the device 10 to aid in the reading process. During the test spin, each marking will pass before the sensor 254*c* to be detected and recorded individually. This information, combined with the information received by the controller 46 regarding the speed of the rotation of the rotor 42, allows the controller 46 to determine the number and distance between each marking which, in turn, allows the controller 46 to form a proper ID of the rotor 42 itself. While the illustrated construction includes markings to be read by the optical reader 254*c*, in alternative constructions, windows (i.e., apertures, not shown) may be formed in the rotor 42 to form the rotor ID tag 258*c*. In such a construction, the size and position of the windows would create a unique code readable by the optical reader 254*c*.

While the present invention illustrates the above referenced sensor 254 and rotor ID 258 combinations, it is to be understood that alternative forms of sensors and alternative forms of rotor ID's may be utilized by the rotor identification system 250.

To operate the device 10 as a centrifuge, the user first pivots the lid 106 from the closed position to the open position. With the lid 106 open, the user now has access to the cavity 58 of the housing 26 via the opening 102. The user may then remove the locking nut 150 from the spindle 34 and remove any non-centrifuge rotor 42 that may already be installed thereon.

With the locking nut 150 removed, the user may then select the appropriate rotor 42 for the desired experiment (i.e., one of the centrifuge type rotors that accommodates the correct tube size). With the appropriate rotor 42 selected, the user may then place the rotor 42 onto the spindle 34 by passing the distal end 90 of the shaft 126 through the corresponding mounting aperture 186 until the positioning surface 138 of the rotor 42 comes into contact with the positioning surface 134 of the base 122 of the spindle 42. With the rotor 42 installed, the user may then secure the rotor 42 in place by threading the locking nut 150 back onto the spindle 34.

With the rotor 42 installed, the rotor identification system 250 of the controller 46 utilizes the sensor 254 to read the corresponding rotor ID tag 258 coupled to the installed rotor 42. Depending upon the type of sensor 254 and ID tag 258 being utilized, the controller 46 may also conduct a test spin to aid the sensor 254 in reading the ID tag 258. Once the rotor identification system 250 has read the ID tag 258, the controller 46 automatically places the device 10 into the first operating mode, thereby limiting any operating speeds to those appropriate for centrifugation. In instances where additional operating parameters are included, the controller 46 may automatically enter those as well. Otherwise the user may enter the operating parameters manually so long as they fall within the permitted operating envelope set by the controller 46 based on the rotor ID tag 258.

With the parameters set, the user may place tubes in the rotor 42, pivot the lid 106 to the closed position, and conduct the experiment.

To operate the device 10 as a magnetic stirrer, the user follows the same steps as listed above, except installing the fourth rotor construction 42*d*. With the rotor 42*d* installed, the controller 46 will follow the standard rotor identification process as described above. Once the process is complete, the controller 46 will automatically place the device 10 in the second operating mode, thereby limiting the operating speeds to those appropriate for magnetic stirring. The user pivots the lid 106 into the closed position and places a container 18 onto the upper surface 114 of the lid 106. The user may then place a stirring bar 22 into the container 18, whereby the magnetic fields produced by the rotor 42*d* will cause the stirring bar 22 to rotate within the container 18, stirring any contents therein.

What is claimed is:

1. A device for use in a laboratory, the device comprising:

a housing defining a cavity therein;

a motor coupled to the housing;

a spindle driven by the motor and rotatable about a first axis; and a first rotor removably couplable to the spindle and configured for centrifugation and to support at least one tube therein;

a second rotor removably couplable to the spindle and including at least one magnet producing a magnetic field, and wherein the magnetic field produced by the at least one magnet is configured to rotate a stirring bar relative to the housing; and a controller in communication with the motor and operable in a first mode of operation when the first rotor is coupled to the spindle, and operable in a second mode of operation when the second rotor is coupled to the spindle.

2. The device of claim 1, wherein the housing includes a lid, and wherein the lid includes a substantially planar upper surface to support a container thereon, and wherein the at least one magnet is positioned proximate the planar upper surface.

3. The device of claim 1, wherein the first mode of operation includes limiting the spindle rotation speeds to speeds appropriate for centrifugation.

4. The device of claim 3, wherein the second mode of operation includes limiting the spindle rotation speeds to speeds appropriate for magnetic stirring.

5. The device of claim 1, wherein the spindle is rotatable within a first envelope of operation during the first mode of operation, and wherein the spindle is rotatable within a second envelope of operation, different than the first envelope of operation, during the second mode of operation.

6. The device of claim 1, wherein the controller is capable of receiving information regarding whether the first rotor or the second rotor is coupled to the spindle.

7. The device of claim 1, wherein the spindle includes an outer positioning surface, and wherein the first rotor includes a rotor positioning surface configured to contact the outer positioning surface of the spindle to orient the first rotor co-axially with respect to the spindle.

8. The device of claim 1, wherein the spindle includes an outer positioning surface, and wherein the second rotor includes a rotor positioning surface configured to contact the outer positioning surface of the spindle to orient the second rotor co-axially with respect to the spindle.

* * * * *